United States Patent [19]

Jenkins

[11] Patent Number: 4,751,621

[45] Date of Patent: Jun. 14, 1988

[54] LIGHT KNIFE

[76] Inventor: Edward L. Jenkins, R.D. 5, Box 427-7, Bingham Rd., Oswego, N.Y. 13126

[21] Appl. No.: 901,265

[22] Filed: Aug. 28, 1986

[51] Int. Cl.[4] ..... B25K 23/18

[52] U.S. Cl. ..... 362/119; 362/267; 362/268; 362/158; 362/187

[58] Field of Search ..... 362/267, 268, 187, 206, 362/119, 253, 158, 120, 109; 30/123; 128/303.1, 305

[56] References Cited

U.S. PATENT DOCUMENTS

| | | | |
|---|---|---|---|
| 1,753,614 | 4/1930 | Meroussis | 362/187 |
| 1,890,841 | 12/1932 | Brown | 362/119 |
| 2,427,526 | 9/1947 | Golder | 362/158 |
| 2,525,414 | 10/1950 | Kleinschmidt | 362/120 |
| 2,588,162 | 3/1952 | Riggio | 362/119 |
| 3,370,163 | 2/1968 | Brill | 362/119 |

*Primary Examiner*—William A. Cuchlinski, Jr.
*Assistant Examiner*—D. M. Cox
*Attorney, Agent, or Firm*—T. M. Gernstein

[57] ABSTRACT

A knife is provided with a light in its handle portion, with the light being actuated by a compression or threaded movement of a cap attached to an end of the handle. In a separate embodiment, the light may be actuated by a threaded movement of the handle end itself, while a protective cap may be positioned over the handle end and its associated light lens.

5 Claims, 2 Drawing Sheets

LIGHT KNIFE

BACKGROUND OF THE INVENTION

1. Field of the Invention

The present invention relates to knives and lights, and more particularly pertains to a combined light and knife which is of a rugged and waterproof construction.

2. Description of the Prior Art

Knives having flashlights combined therewith are known in the prior art. For example, U.S. Pat. No. 3,370,1163, which issued to D. Brill on Feb. 20, 1968, discloses an implement holder having a pair of slots directed therethrough, with one such slot being designed to retain a knife and the second slot being designed to retain a flashlight. The implement holder further includes an appropriate switch indentation to thus control the operation of the light. However, the Brill device is effectively an apparatus which permits the combining of normally separate knives and flashlights, and is not directly related to a combination flashlight and knife assembly. Further, this device is of a bulky construction and would most likely be difficult to manufacture in a size and shape that would accommodate the many designs of knives and flashlights now on the market.

Another prior art knife and flashlight combination is shown in U.S. Pat. No. 1,890,841, which issued to R. Brown on Dec. 13, 1932. The knife shown in this patent includes a hollow handle that is designed to retain a battery and light bulb. As such, the handle operates as a flashlight with the light being directed in an direction opposite to the positioning of the associated blade. The Brown knife includes a switch formed through a side portion of the handle with this switch being operable to control the operation of the flashlight. While the Brown knife and flashlight would apparently function as desired, it can be appreciated that its use would be limited since the switch opening in the handle would permit the entry of dirt and water into the battery holding chamber. Accordingly, the Brown knife is not ideally suited for rugged outdoor uses, especially for such uses which would require a waterproof casing. Further, the exterior positioning of the switch is inconvenient inasmuch as the switch could be accidentally actuated which would then result in a drainage of battery power, while the switch could also interfere with the positioning of the knife in a carrying sheath or the like.

Accordingly, it can be appreciated that there exists a continuing need for new and improved combined knives and flashlights wherein the same may be more efficiently and reliably operated, while also being suitable for use in rugged and wet environments. In this respect, the present invention substantially fulfills this need.

SUMMARY OF THE INVENTION

In view of the foregoing disadvantages inherent in the known types of combined knives and flashlights now present in the prior art, the present invention provides an improved combined knife and flashlight construction wherein the same can be more reliably used in rugged and wet environments. As such, the general purpose of the present invention, which will be described subsequently in greater detail, is to provide a new and improved combined flashlight and knife which has all the advantages of the prior art combined flashlights and knives, and none of the disadvantages.

In attaining this purpose, it will be noted that the light knife comprising the present invention is effectively a combination knife and light that obviates the need for two separate items. The two items are combined in one molded unit that can be carried in a sheath strapped either to the belt or waist of a user. Inasmuch as the knife is designed to be waterproof, it will be a useful, it not indispensable, item for outdoorsmen of all types. It can be an important addition to survival and first aid kits, and has military applications in many areas. The potential military market is one of great volume, as is the market for the fisherman, hunter, scuba diver, backpacker, and scores of other users. It is compact and light in weight, and will add far less to the total carrying burden than those afforded by prior art.

The handle of the knife contains a lens at the top with a light bulb positioned behind the lens. Within the handle itself is contained the necessary batteries that serve as the power source for the light, while the lens cap is removable at the end in order to insert and remove the batteries when necessary. A rubber O-ring may be provided to complete the water protection at this joint.

In a preferred embodiment, the light knife will be approximately 9 inches in total length, including the knife and light, and the blade will tapper from approximately from 1 inch at the junction with the light handle. The light handle will be approximately 1½ inches in diameter; however, the relative sizes of the handle and the blade will depend in part on the type of light bulb and power source used. The knife blade itself should be approximately 5 to 6 inches long, tapering sharply to a point. For added versatility, one side of the blade could be honed to a sharp edge, with the other side being equipped with saw teeth for rough use in the field. The blade should be stainless steel with the tang or shank portion which fits into the handle being molded of one piece with the blade for added durability.

The light case, which is also the handle of the light knife, should ideally be constructed of a high-impact ABS plastic. In the preferred embodiment, the handle will be equipped with a one piece molded, threadably attachable, shatterproof lexan lens and with a diamond patterned lexan reflector to enhance light projection. A krypton high intensity flashlight bulb is adequate, inasmuch as this type of bulb will provide at least twice the light of a conventional flashlight bulb with up to three times the range and two to three times greater life expectancy. These bulbs can be used with any size alkaline battery or rechargeable nickel cadmium battery. A regular krypton bulb can be used with carbon zinc batteries, while halogen bulbs could also be used with the same success.

The light knife may be provided with its own sheath that is approximately 10 inches long by one and one half inches wide. The sheath may be constructed of high quality leather and may be fitted with two straps—a small Velcro strip that will loop vertically around the wearer's belt and a rubber leg strap with a Velcro strip at either end to secure the bottom of the sheath to the wearer's leg. A knife pocket is provided for the blade portion of the knife so as to leave the handle exposed. To the observer, the sheath appears to contain only a flashlight, while the blade is concealingly and tightly fitted in the pocket and held in place only by the tight fit. The light knife may also be fitted with a plastic or rubber lens cover that will keep the plastic lens from scratching. Such a cover could resemble the covers used on binoculars and other optical instruments for lens protection.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved combined flashlight and knife which has all the advantages of the prior art combined flashlights and knives and none of the disadvantages.

It is another object of the present invention to provide a new and improved combined flashlight and knife which may be easily and efficiently manufactured and marketed.

It is a further object of the present invention to provide a new and improved combined flashlight and knife which is of a durable and reliable construction.

An even further object of the present invention is to provide a new and improved combined flashlight and knife which is susceptible of a low cost of manufacture with regard to both materials and labor, and which accordingly is then susceptible of low prices of sale to the consuming public, thereby making such combined flashlights and knives economically available to the buying public.

Still yet another object of the present invention is to provide a new and improved combined flashlight and knife which provides in the apparatuses and methods of the prior art some of the advantages thereof, while simultaneously overcoming some of the disadvantages normally associated therewith.

Still another object of the present invention is to provide a new and improved combined flashlight and knife wherein the light may be switched on and off by a threaded movement of the handle.

Yet another object of the present invention is to provide a new and improved combined flashlight and knife which is characterized by a lightweight, rugged and waterproof construction.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
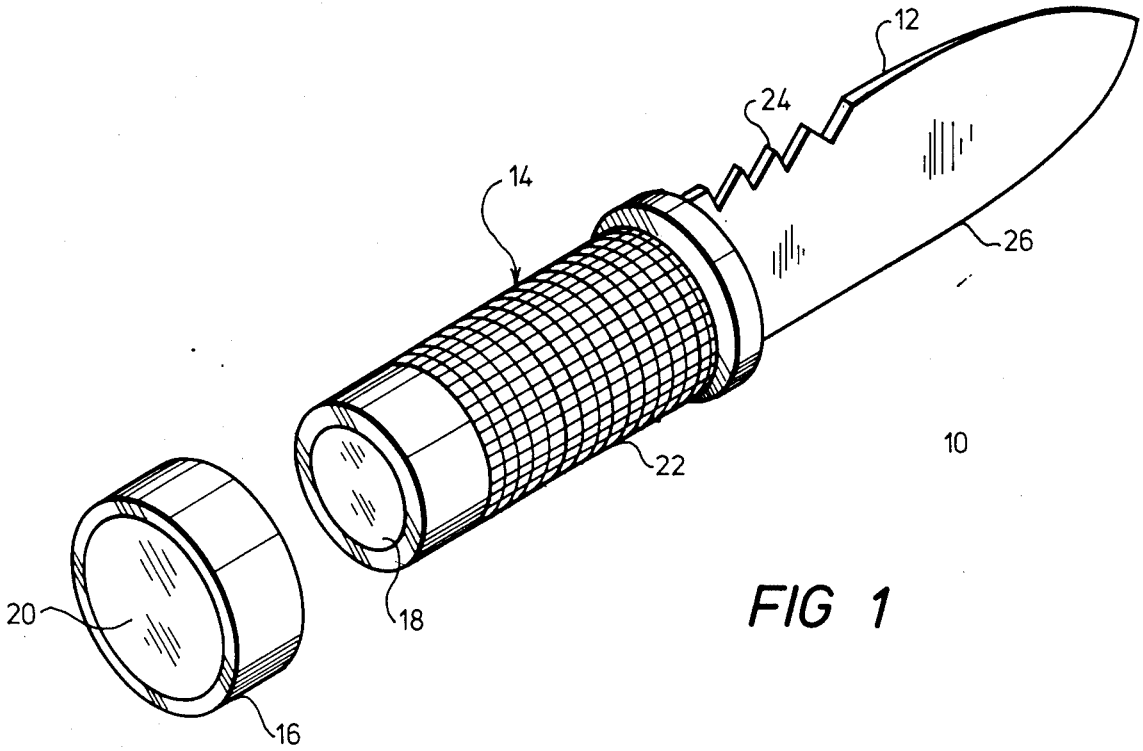
FIG. 1 is a perspective view of the light knife comprising the present invention.
Figure 2:
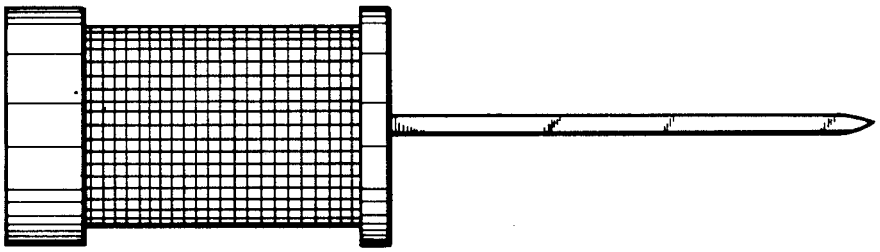
FIG. 2 is a side elevation view thereof.

With reference now to the drawings and in particular to FIGS. 1 and 2 thereof, a new and improved combined flashlight and knife embodying the principles and concept of the present invention and generally designated by the reference numeral 10 will be described.

More specifically, it will be noted that the light knife 10 includes a conventional knife blade 12 attached to a handle 14 with a separable lens cover 16 being positionable over an end of the handle. The handle 14 includes at its free end a transparent lens 18, while the lens cover 16 may also in one embodiment include a transparent end portion 20.

As illustrated, the handle 14 may include any type of surface covering 22, thereby the enhance the grip characteristics of the knife 10, while the blade 12 may be formed in any conceivable and known shape. In this respect, the blade 12 could include a plurality of saw teeth 24 on one edge thereof, with the remaining edge 26 then being sharpened so as to function in the manner of a cutting edge. While the knife 12 and handle portion 14 have been shown in one particular shape and design, it is to understood that such blade and handle could be shaped into any conceivable design, and all such shapes and designs are within the intent and purview of the present invention.

Figure 3:
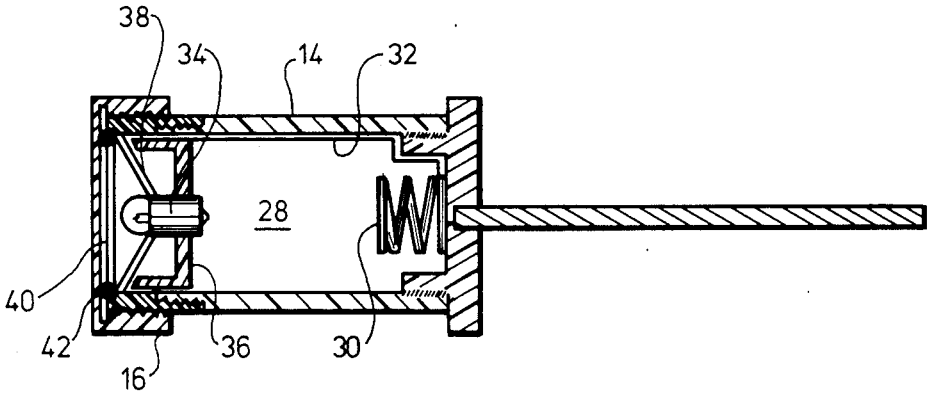
FIG. 3 is a cross-sectional view of the knife showing its operational components.

FIG. 3 of the drawings illustrates the internal operable components of the invention wherein it can be seen that the handle 14 includes a hollow chamber 28 designed to receive a conventional battery as above-described. A spring 30 is positioned at a bottommost portion of the chamber 28 and serves as a conventional conductor which is in electrical communication with a side positioned conductor 32 positioned along a wall portion of the chamber 28. A light bulb 34 is retained within a flexible polymeric holder 36 which is fixedly secured to the conductor 32, thereby to remain within a fixed position within the chamber 28. The light bulb 34 is provided with a cone-shaped reflector and conductor 38 which is normally spaced apart from the conductor 32 with the flexible holder 36 being moveable to permit electrical communication between the conductors 32, 38. The lens cover 16 may be compressibly or threadably attached to the handle 14, while a lens 40 is securely positioned across the cone-shaped conductor 38. To facilitate a waterproof construction, a rubber O-ring 42 is attached or otherwise fixedly secured within an interior portion of the lens cover 16, with such O-ring being compressibly engageable with the lens 40 during a movement of the lens cover 16 onto the handle 14. A compression of the O-ring 42 will result in a downward movement and flexing of the holder 36, thereby to permit electrical communication between the conductors 32, 38.

With respect to the manner of usage and operation of the light knife 10, the same should be apparent from the above description. However, a brief summary thereof will be provided. More particularly, it can be seen that the lens cover 16 operates as the switch by which the light bulb 34 is operably turned on and off. In this connection, the lens cover 16 may be compressed or threadably moved downwardly along the handle 14 to effect a compression of the O-ring 42 which in turn places a downward force on the lens 40 and the light bulb 34 attached thereto. The polymeric holder 36 will then flexibly move downwardly so as to achieve a partial cone shape, with the movement then permitting the reflector conductor 38 to come in to electrical communication with the conductor 32, thus to complete the electrical operating circuit. A reverse movement of the lens cover 16 along the handle will result in an extinguishment of the light bulb 34.

In a modified embodiment of the invention, the lens cover 16 could operate solely as a lens cover, while an end portion of the handle 14 could then be threadably removable in the manner of the above-described lens cover. In this embodiment, the lens cover 16 would not function as the switch means.

With respect to the above description then, it is to realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A combination flashlight and knife, comprising:

a. knife means including handle means;

b. illumination means operably affixed to said handle means, said illumination means including a lens mounted in an end of said handle means; and, c. lens cover means positionable over said lens, said lens cover means including a further tansparent lens alignable with said first mentioned lens; and, d. switch means for operating said illumination means, said switch means being operated by a movement of said handle means, said switch means including said lens cover means.

2. The combination flashlight and knife of claim 1, wherein said lens cover means is threadably attached to said handle means.

3. The combination flashlight and knife of claim 2, and further including an O-ring positionable between said lens cover means and said illumination means, said O-ring being compressible upon a movement of said lens cover means to effect a closing of an electrical circuit within said handle means, thereby to actuate said illumination means.

4. The combination flashlight and knife of claim 3, and further including waterproof means to permit a use of said combination flashlight and knife in wet environments.

5. The combination flashlight and knife of claim 4, wherein said O-ring comprises said waterproof means.

* * * * *